US009872578B2

(12) United States Patent
Held

(10) Patent No.: US 9,872,578 B2
(45) Date of Patent: Jan. 23, 2018

(54) HOLDER FOR ROUND OBJECTS FOR EVERYDAY USE, SUCH AS BOTTLES, PLATES, BOWLS, DISHES, AND THE LIKE

(71) Applicant: FORM ORANGE PRODUKTENTWICKLUNG, Hard (AT)

(72) Inventor: Wolfgang Held, Hard (AT)

( * ) Notice: Subject to any disclaimer, the term of this patent is extended or adjusted under 35 U.S.C. 154(b) by 0 days.

(21) Appl. No.: 15/026,231

(22) PCT Filed: Jul. 23, 2014

(86) PCT No.: PCT/EP2014/065797
§ 371 (c)(1),
(2) Date: Mar. 30, 2016

(87) PCT Pub. No.: WO2015/024724
PCT Pub. Date: Feb. 26, 2015

(65) Prior Publication Data

US 2016/0286991 A1 Oct. 6, 2016

(30) Foreign Application Priority Data

Aug. 19, 2013 (DE) ..... 10 2013 108 929

(51) Int. Cl.
*A47J 47/16* (2006.01)
*A47G 19/08* (2006.01)
*A47G 23/02* (2006.01)

(52) U.S. Cl.
CPC ..... *A47G 19/08* (2013.01); *A47G 23/0241* (2013.01)

(58) Field of Classification Search
CPC ..... A47G 23/0241
USPC ..... 294/28, 31.2, 27.1, 33; 248/312, 311.2, 248/145.6, 145; 220/741; D7/622; 215/395, 396
See application file for complete search history.

(56) References Cited

U.S. PATENT DOCUMENTS 547,713 A * 10/1895 Coutenay ..... B65D 23/106 16/425
2,029,051 A * 1/1936 Blevins ..... A47G 23/0241 215/395
2,087,375 A 7/1937 Ehrhardt
2,088,387 A * 7/1937 Rice, Jr. ..... A47G 23/0241 206/446
2,116,148 A * 5/1938 Hawley ..... A45F 5/10 206/446
2,463,651 A * 3/1949 Stevens ..... A47G 23/0241 215/395
2,532,244 A * 11/1950 Pasmore ..... A47G 23/0266 211/85.18

(Continued)

*Primary Examiner* — Paul T Chin
(74) *Attorney, Agent, or Firm* — John Alumit

(57) ABSTRACT

A holder for round objects for everyday use, such as bottles, plates, bowls, dishes, and the like with a positioning plate and two approximately semicircularly curved holder plates. The holder plates can be brought from an open insertion position into a closed holding position and enclose the objects placed on the positioning plate. By means of a special embodiment of the positioning plate and the novel embodiment of the rotary support of the holder plates, a unit is created that is closed in the holding position, in which the objects placed in it are unequivocally fixed and secured on the positioning plate, so that the unit can be transported and set up again at a different location.

9 Claims, 6 Drawing Sheets

(56) References Cited

U.S. PATENT DOCUMENTS

Figure 1:
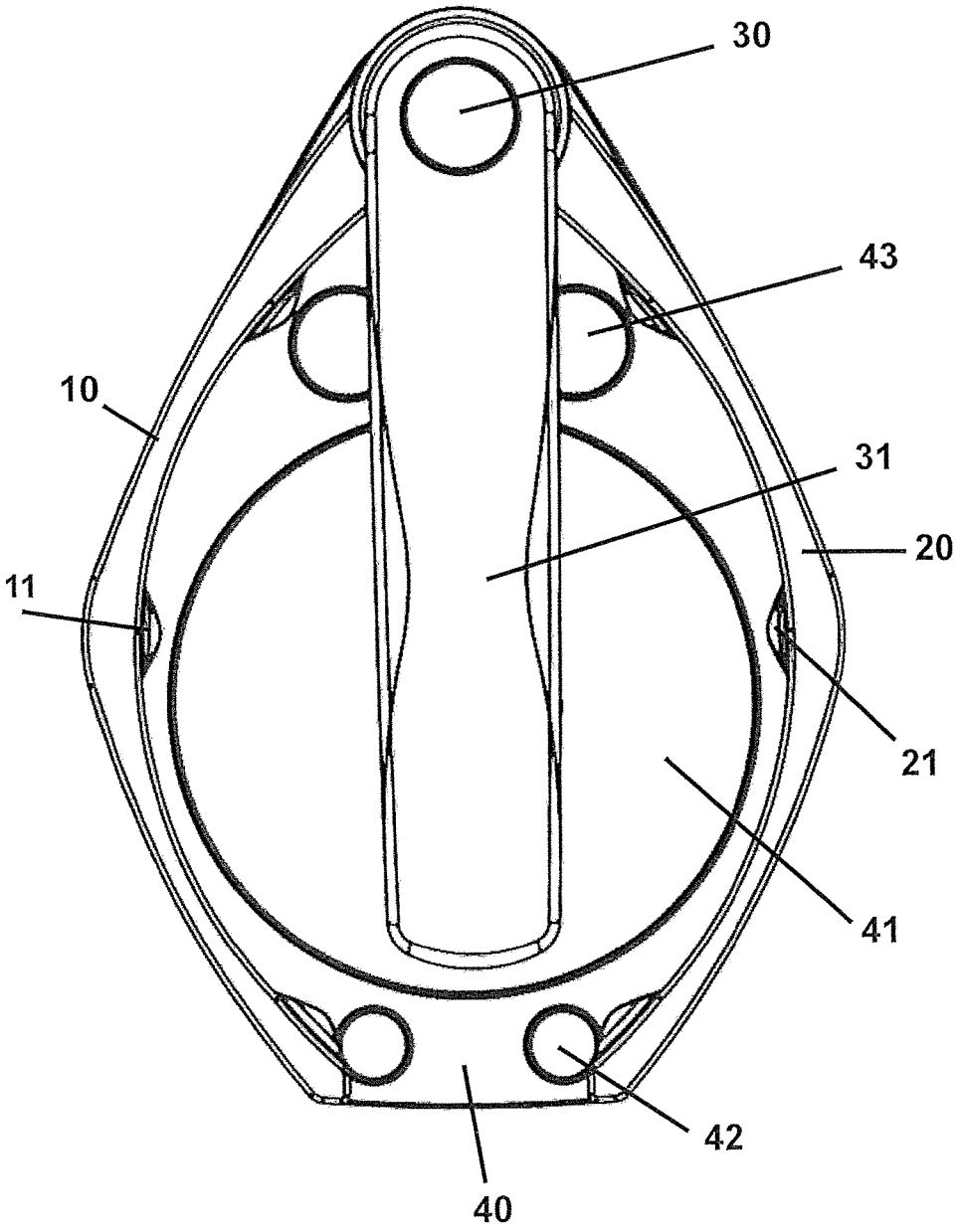

| | | | | |
|---|---|---|---|---|
| 3,719,305 | A * | 3/1973 | Pressnell | A47G 23/0233 215/395 |
| 4,606,523 | A * | 8/1986 | Statz | A47G 23/0225 211/74 |
| 4,923,236 | A | 5/1990 | Bunck | |
| 5,013,074 | A * | 5/1991 | Galle | B65D 23/106 215/395 |
| 6,220,557 | B1 * | 4/2001 | Ziaylek | A62C 13/78 248/154 |
| 7,669,742 | B2 * | 3/2010 | Rush | A45F 5/00 102/336 |
| 8,104,808 | B1 * | 1/2012 | Newlin | A21C 9/08 294/106 |
| 2004/0135049 | A1 * | 7/2004 | Kent-Fawkes | B65D 23/106 248/311.2 |

* cited by examiner

HOLDER FOR ROUND OBJECTS FOR EVERYDAY USE, SUCH AS BOTTLES, PLATES, BOWLS, DISHES, AND THE LIKE

CROSS-REFERENCE TO RELATED APPLICATION

This application is a national stage patent application arising from PCT/EP2014/065797 filed on Jul. 23, 2014, and referenced in WIPO Publication No. WO2015/024724. The earliest priority date claimed is Aug. 19, 2013.

FEDERALLY SPONSORED RESEARCH

None

SEQUENCE LISTING OR PROGRAM

None

BACKGROUND

The invention relates to a holder for round objects for everyday use, such as bottles, plates, bowls, dishes, and the like, as recited in the preamble to claim 1.

From DE 196 29 577 A1, one such holder is known, which has an positioning plate and two semicircular holder plates, which with their concave sides facing toward one another can be put along a vertical side from an open insertion position into a closed holding position; the outer diameter of the objects placed on the positioning plate is adapted to the inner diameter of the holder plates placed in the holding position. The adjustment mechanism is located between a lid and a bottom plate, which are connected to one another in articulated fashion. The adjustment mechanism includes a complicated mechanical gear, which is controllable when the lid is closed onto a vertical lower part. In the process the holder plates are moreover manually adjustable to a predetermined holding position, and that position is automatically adjustable as the lid is closed. The holder plates then rest on the objects for everyday use that have been put in place only under spring tension and therefore need to be deflected slightly outward on being inserted into the holder.

In DE 10 2008 060 930 A1, the holder is intended for only a single bottle and has a fixed arc-shaped holder, for which a similarly movable holder can be put in a holding position. Such a holder is not suitable for stacking stacked objects for everyday use.

DE 10 2011 004 507 A1 shows a holder for individual objects that are round, such as beakers, cans or bottles; it has a housing with a through-opening that is closable with an elastic portion. That portion makes the inserted object resiliently fixed in the housing. This holder, too, is suited only for receiving a single object, but not for a stack of objects.

From DE 298 17 904 U1, a clampable bottle holder is known that is divided into two shell-like parts. The two parts are hinged together and can be fastened to one another by way of locks. One part has a handle. In the closed state of the parts, the holder holds a heavy bottle, which makes the bottle easy to manipulate.

U.S. Pat. No. 6,652,793 B2 shows a cup holder for a vehicle, which has two movable holder arms that hold the cup, inserted into it, resiliently but firmly. The two holder arms are secured to the vehicle via a supporting base.

It is the object of the invention to create a holder for round objects for everyday use, such as bottles, plates, bowls, dishes and the like, into which objects for everyday use can easily be inserted and taken out again; the insertion position of the objects into the holder can be secured unequivocally.

SUMMARY

The invention is based on a holder which has a positioning plate and two approximately semicircularly placed holder plates, which with their concave sides oriented toward one another can be brought along a vertical side from an opened insertion position into a closed, securable holding position; the outer diameter of the objects placed on the positioning plate is adapted to the inner diameter of the holder plates placed in the holding position.

According to the invention, it is provided that the positioning plate is provided with a central indentation and laterally raised demarcation stops for the holding position of the holder plates; that both holder plates are supported fixedly and nonrotatably on shafts located side by side; that the shafts are rotatably supported in the positioning plate; that both shafts are coupled to one another via gear wheels that mesh with one another; that one shaft is provided with a handle, and the handle is connected to the shaft in such a way that in the insertion position, it extends at a tangent to the open holder plates, while in the holding position it diagonally crosses the closed holder plates; and that both holder plates are connectable to one another in the holding position via closure elements that are located on the holder plates on the vertical side that is opposite from the rotary support of the positioning plate.

In the open insertion position of the holder plates, the stacked article or articles of everyday use can easily be set down on the positioning plate. In the holding position, they are then unequivocally fixed and held in the closed holder plates, so that the entire unit can be carried safely and set down at a different location. As an example, plates can be washed and then stacked in part of a cupboard. The central indentation in the positioning plate and its lateral demarcation stops for the holding position of the holder plates play an essential role.

Advantageous embodiments of the holder can be learned from the dependent claims.

A simplification can be embodied such that the holder plates are connected to the positioning plate via a vertical shaft, which is passed through hingelike offset eyelets of the holder plates, and one holder plate is connected nonrotatably in the holding position to the positioning plate, while the other holder plate is fixedly connected to the shaft, which is rotatably supported in the positioning plate and can be put with a handle into the holding position.

The connection of the holder plates in the holding position can be embodied such that the holder plates are provided with closure eyelets, which in the holding position of the holder plates are located vertically one above the other and are connectable to one another by means of a holder pin. However, it can also be embodied such that the holder plates are connectable to one another in the holding position via detent elements and detent receptacles.

In one embodiment, the holder plates comprise elastic material. The holder plates, made from plastic by injection molding, are provided on their concave inner sides with an elastic covering, for instance of plastic foam. The holder plates can also be composed of different-colored partial plates.

Instead of only one shaft for both holder plates, it can also be provided that one holder plate is connected fixedly and nonrotatably to an upper partial shaft and the other holder plate is connected fixedly and nonrotatably to a lower partial shaft, and the partial shafts are connected to one another via a reversing gear, and the lower partial shaft is rotatably supported in the positioning plate.

Finally, the hold of the objects held between the holder plates can be still further improved by providing that when the holder plates rest on the objects for everyday use that have been put down on them, the holder plates are pre-stressed on their shafts via springs.

DRAWINGS

Figure 2:
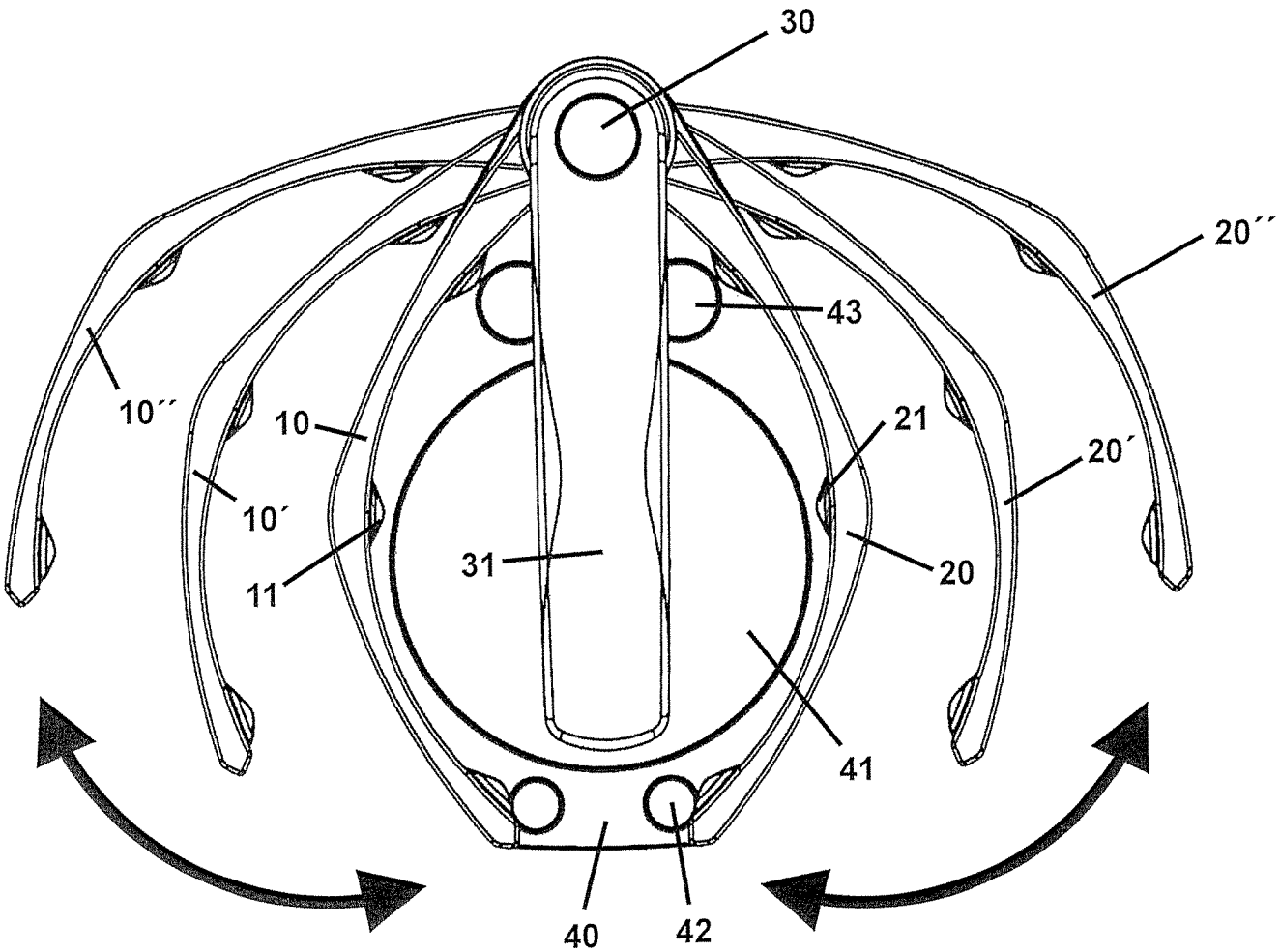
Figure 3:
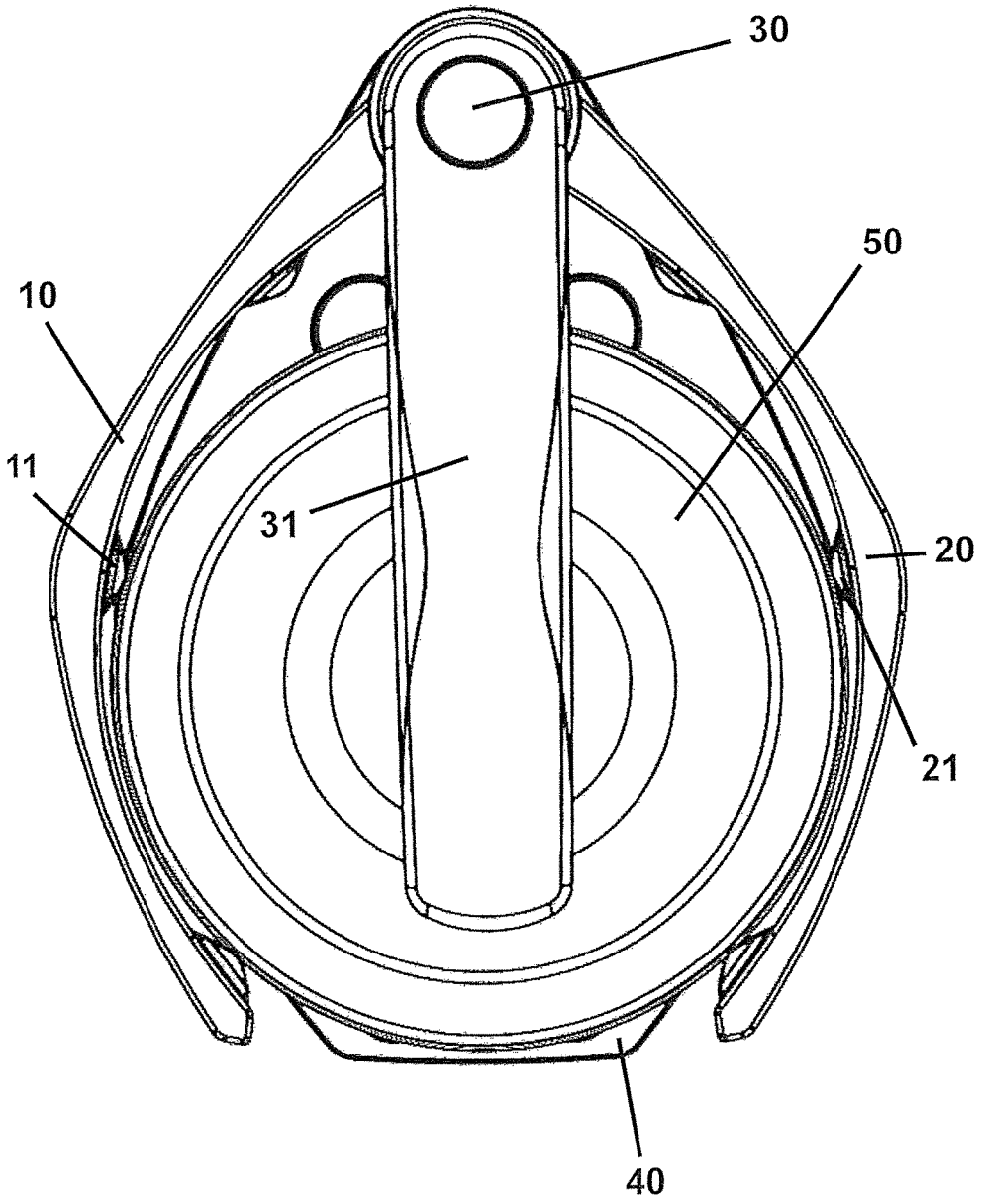
Figure 4:
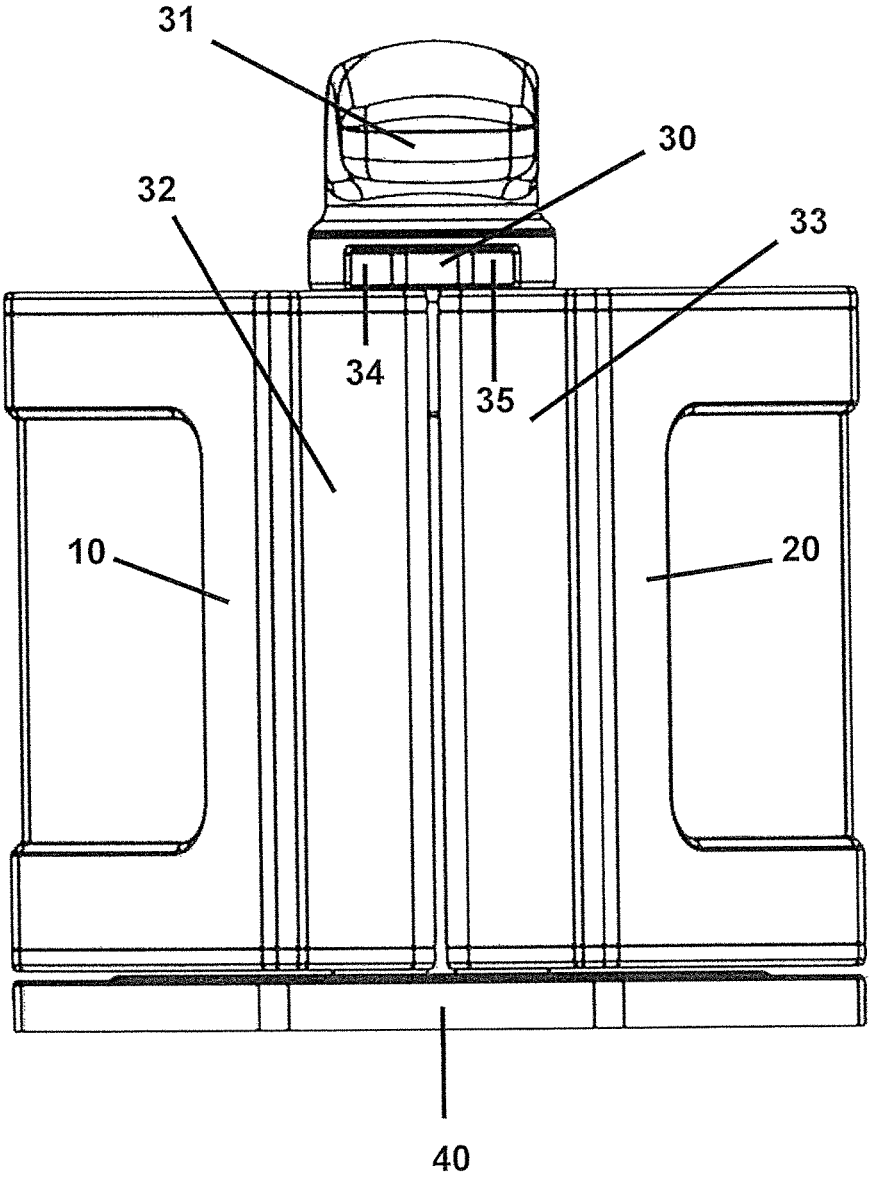
Figure 5:
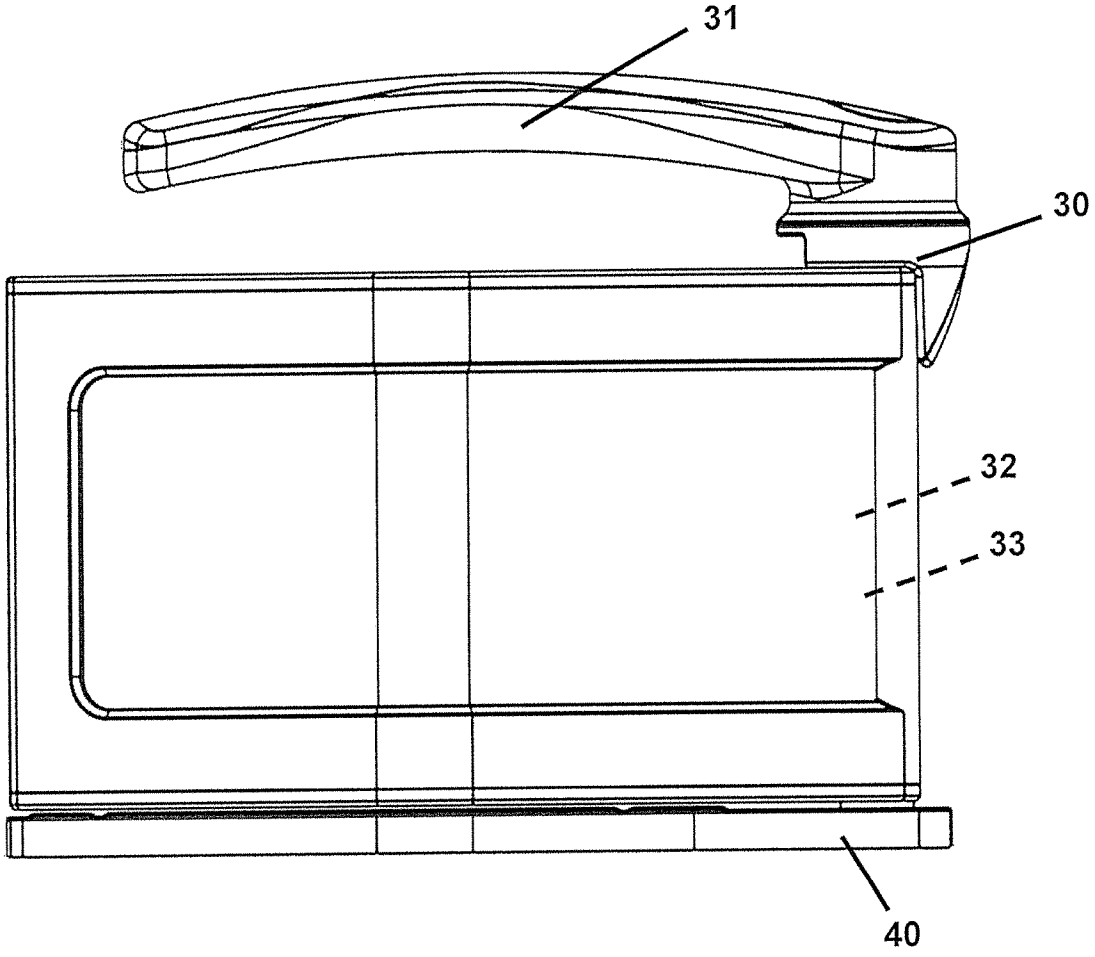
Figure 6:
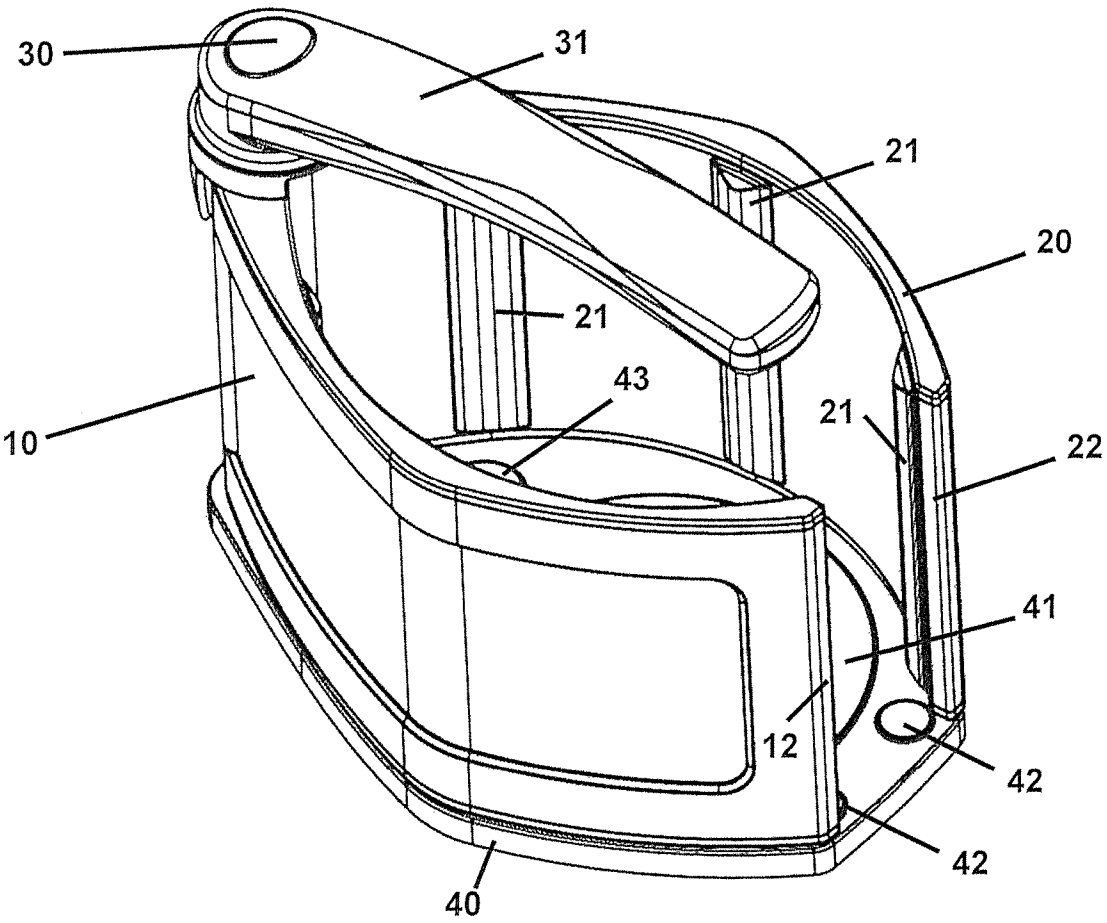

Exemplary embodiments of the invention are shown and described in further detail in conjunction with the drawings. Shown are:

FIG. 1, the plan view of a holder in a closed, empty holding position;

FIG. 2, the plan view of the holder of FIG. 1 in the open insertion position of the holder plates;

FIG. 3, the plan view of the holder of FIG. 1 in the closed holding position with the plates set down on it;

FIG. 4, a holder with separate shafts for the holder plates in a front view;

FIG. 5, a further perspective side view of the holder of FIG. 4, which is offset from that drawing by 90°; and FIG. 6, a perspective view of the closed holder with an empty receiving chamber.

DETAILED DESCRIPTION

FIG. 1 shows the holder in the closed, empty position, in which the handle 31 of the shaft 30 extends diagonally across the positioning plate 40. The positioning plate 40 can be provided with a central indentation 41 and lateral raised stops 42 and 43 for securely setting down the plates, bowls and the like.

As FIG. 2 shows, from this basic position the holder plates 10 and 20 can be pivoted outward into an insertion position. In that process the handle 31 with the shaft 30 is rotated more and more tangentially to the holder. The holder plates 10 and 20 can also be adjusted contrarily, as indicated by the positions 10' and 10" and 20' and 20", respectively. This is achieved by corresponding coupling of the drive shaft 30 of the handle 31, as will be shown below.

The plates 50 that have been put in place can be held in secured fashion in the holding position of FIG. 3, in which the holder plates 10 and 20 contact the plates 50 by way of elastic elements 11 and 21. The holding position of the holder plates 10 and 20 can be secured even further by means of integrally formed-on closing elements.

In FIG. 4, the holder is shown in a front view, in which the gear wheels 34 and 35, coupled to the drive shaft 30, form a reversing gear for separate shafts 32 and 33. In this way, it is attained that with a single rotation of the handle 31, both holder plates 10 and 20 simultaneously experience a contrary pivoting. This can also be achieved by means of a split drive shaft 30, in which both partial shafts are coupled via a reversing gear, and the lower partial shaft is rotatably supported in the positioning plate 40 and the upper partial shaft is connected fixedly and nonrotatably to the handle 31.

FIG. 5 shows the holder in the holding position, in a position rotated by 90° from FIG. 4.

The inner diameter of the concave sides of the holder plates 10 and 20 is adapted to the outer diameter of the various objects to be set down, such as plates, bowls, bottles, and the like. This means that a fixed unit in the stack can be attained for each type of dish.

The holder plates 10 and 20 may be produced from plastic and have coverings 11 and 21 of plastic foam, which are embodied as vertical strips.

The positioning plate 40 can be produced as a deep-drawn plastic part, in which the indentation 41 in the middle of the positioning plate 40 ensures a better hold of the objects for everyday use. The same purpose is also attained by the stops 42 and 43 protruding from the upper side of the positioning plate 40, which contact the outer circumference of the objects set down, at least of the lowermost object for everyday use.

Finally, FIG. 6 shows a perspective view of the holder, in which the empty holder can be seen in the holding position. The contact of the holder plate 20 with the demarcation stops 42 and 43 of the positioning plate 40 can be seen. Moreover, the coverings 11 and 21 on the concave inner sides of the holder plates 10 and 20 can be seen as vertical strips, which protrude from the concave insides of the holder plates 10 and 20 and are able, being pressed together, to contact the stack of inserted objects. The closed holding position of the holder plates 10 and 20 can be made absolutely secure by closure elements (not shown), which are mounted on the sides 12 and 22 of the holder plates 10 and 20 opposite the rotary support of the holder plates 10 and 20. The holder then forms a fixed, closed unit around the inserted objects.

What is claimed:

1. A holder for round objects for everyday use, having an positioning plate (40) and two approximately semicircularly curved holder plates (10, 20), which, with their concave sides facing toward one another, can be moved along a vertical side from an open insertion position into a closed, securable holding position, the outer diameter of the objects (50) placed on the positioning plate (40) being adapted to the inner diameter of the holder plates (10, 20) put in the holding position, characterized in that the positioning plate (40) is provided with a central indentation (41) and laterally raised demarcation stops (42, 43) for the holding position of the holder plates (10, 20);

that both holder plates (10, 20) are supported fixedly and nonrotatably on shafts (32, 33) located side by side;

that the shafts (32, 33) are rotatably supported in the positioning plate (40);

that both shafts (32, 33) are coupled to one another via gear wheels (34, 35) that mesh with one another;

that one shaft is connected fixedly to a handle (31), that the handle is connected to a split drive shaft (30) which is in contact with the gear wheels (34,35) so that when the handle is rotated tangentially to the holder, the handle (31) rotates the split drive shaft, which in turn rotates the gear wheels forcing the shafts (32,33) to open the holder plates, and when the handle is rotated back to its original position, the handle rotates the split drive shaft, which in turn rotates the gear wheels forcing the shafts (32, 33) to close the holder plates;

that both holder plates (10, 20) are connectable to one another in the holding position via closure elements that are located on the holder plates (10, 20) on the vertical side, opposite from the rotary support of the positioning plate (40).

2. The holder of claim 1, characterized in that the holder plates (10, 20) are connected to the positioning plate (40) via the split drive shaft (30), which is passed through hingelike offset eyelets of the holder plates (10, 20), and one holder plate (10) is connected nonrotatably in the holding position to the positioning plate (40), while the other holder plate (20) is fixedly connected to the split drive shaft (30), which is rotatably supported in the positioning plate (40) and can be put with a handle (31) into the holding position.

3. The holder of claim 2, characterized in that one holder plate (20) is connected fixedly and nonrotatably to an upper partial shaft and the other holder plate (10) is connected fixedly and nonrotatably to a lower partial shaft, and the partial shafts are connected to one another via a reversing gear, and the lower partial shaft is rotatably supported in the positioning plate (40).

4. The holder of claim 1, characterized in that the holder plates (10, 20) are provided with closure eyelets, which in the holding position of the holder plates (10, 20) are located vertically one above the other and are connectable to one another by means of a holder pin.

5. The holder of claim 1, characterized in that the holder plates (10, 20) are connectable to one another in the holding position via detent elements and detent receptacles.

6. The holder of claim 1, characterized in that the holder plates (10, 20) comprise elastic material.

7. The holder of claim 6, characterized in that the holder plates (10, 20), produced by injection molding from plastic, are provided on at least a portion of their concave inner sides with an elastic covering (11, 21), for instance of plastic foam.

8. The holder of claim 1, characterized in that the holder plates (10, 20) are composed of different-colored partial plates.

9. The holder of claim 1, characterized in that the holder plates (10, 20) are prestressed on their shafts (30; 32, 22) via springs, when the holder plates rest on the objects for everyday use (56) that have been set down on them.

* * * * *